US005447296A

United States Patent [19]

Cox

[11] Patent Number: 5,447,296

[45] Date of Patent: Sep. 5, 1995

[54] CLOTH SPREADING SYSTEM

[76] Inventor: Michael A. Cox, 4930 Bridlepath La., Greenville, S.C. 29615

[21] Appl. No.: 67,781

[22] Filed: May 26, 1993

[51] Int. Cl.[6] ..... B65H 29/46; B65H 20/24

[52] U.S. Cl. ..... 270/30; 226/113; 226/116; 226/118; 242/418.1; 242/420.6

[58] Field of Search ..... 270/30, 31, 39; 226/23, 226/113, 116, 118, 119; 242/418.1, 420.6

[56] References Cited

U.S. PATENT DOCUMENTS

| | | | |
|---|---|---|---|
| 2,148,375 | 2/1939 | Krassner | 270/31 |
| 2,210,925 | 8/1940 | Hill | 226/23 |
| 2,587,811 | 3/1952 | Bieber | 270/30 |
| 3,116,032 | 12/1963 | Roberts | 242/418.1 |
| 3,523,473 | 8/1970 | Norcross et al. | 270/30 X |
| 3,645,524 | 2/1972 | Grimm et al. | 270/31 |
| 3,735,223 | 5/1973 | Fort et al. | 270/30 X |
| 3,887,628 | 4/1975 | Beckers . | |
| 4,033,573 | 7/1977 | Wortman . | |
| 4,256,270 | 3/1981 | Lee et al. | 242/420.6 |
| 4,708,331 | 11/1987 | Etcheparre et al. | 270/31 |
| 4,946,150 | 8/1990 | Jung . | |
| 4,958,819 | 9/1990 | Jung . | |
| 4,982,940 | 1/1991 | Jung . | |
| 4,984,772 | 1/1991 | Freund . | |
| 5,024,429 | 6/1991 | Etcheparre et al. | 270/30 |
| 5,046,709 | 9/1991 | Beal . | |
| 5,149,075 | 9/1992 | Crowley et al. | 270/39 |
| 5,195,690 | 3/1993 | Cross et al. | 242/418.1 X |

FOREIGN PATENT DOCUMENTS

| | | | |
|---|---|---|---|
| 2138119 | 2/1972 | Germany | 270/30 |
| 518540 | 2/1940 | United Kingdom . | |
| 546549 | 3/1977 | U.S.S.R. | 270/30 |

*Primary Examiner*—John E. Ryznic

*Attorney, Agent, or Firm*—Cort Flint; Henry S. Jaudon

[57] ABSTRACT

A spreading system for spreading cloth in flat, aligned and vertically arranged layers on a spreading table comprising a reciprocally driven spreading machine arranged on a spreading table, and a stationary supply of cloth arranged near one end of the spreading table for supplying cloth to the spreading machine. An overhead cloth support and delivery assembly cooperates with the spreading machine and the cloth supply to support and deliver cloth drawn from the cloth supply to the spreading machine. The support and delivery assembly is supported for movement which is synchronous with the movement of the spreading machine by guides arranged longitudinally of the spreading table. The system operates so that longitudinal movement of the spreading machine away from the cloth supply draws cloth from the supply over the support and delivery assembly and delivers it to the spreading machine which spreads it on the spreading table. Movement of the spreading machine toward the cloth supply delivers cloth to the spreading machine solely from the support and delivery apparatus.

57 Claims, 6 Drawing Sheets

CLOTH SPREADING SYSTEM

BACKGROUND OF THE INVENTION

The present invention is directed to a system for spreading cloth onto an elongated spreading table in vertically stacked flat lengths. The cloth spreading system is based on a stationary supply of cloth arranged near the spreading table.

Spreading systems now in use include the usual spreading table on which a spreading machine is mounted. The spreading machine is reciprocated along the length of the spreading table, either manually or by a mechanized drive system, to spread the cloth in flat stacked layers. The spreading tables may be relatively short, approximately 20 feet, or extremely long, up to 200 feet. The longer tables are most desirable because they provide for less handling of the cloth to produce the same number of cut patterns.

The current spreading systems employ a supply of cloth to be delivered to the spreading machine by actually mounting a cloth roll on the machine. Typical arrangements now in use are shown in U.S. Pat. Nos. 4,982,940; 4,958,819; and 4,946,150. The system of each of these patents is limited by the size of the supply cloth roll. This is because the spreading table and the spreading machine have limited capability governed by the weight which they can support and the bulk which they can accommodate.

A disadvantage of a limited cloth supply is increased down time. Each time the cloth supply is exhausted, the spreading operation must be stopped and a new cloth roll mounted on and threaded through the spreading machine. Due to the size and weight of the cloth roll, this procedure typically requires at least two operators and is time consuming.

Attempts to provide a spreading mechanism capable of utilizing a stationary cloth supply with a cloth spreading machine have not been successful because problems associated with uniform tension and edge alignment could not be overcome.

The U.S. Pat. Nos. 5,046,709 to Beal and 4,984,709 to Freund are directed to fabric delivery means for delivering a web to be cross-lapped. While the web is stacked as a continuous sheet, the controlling apparatus is not directed to cloth spreaders for use with cloth spreading tables and are not capable of obtaining the precise edge control required. The disclosed apparatus is further not capable of spreading cloth over the great lengths necessary for modern spreading tables.

The Great Britain patent No. 518,540 to Monforts is directed to a cloth folding device capable of spreading only short lengths of cloth and operates with no apparent edge control means.

Accordingly an object of the present invention is to provide a cloth spreading system and method for spreading cloth in evenly stacked layers on a spreading table from a stationary cloth supply.

Another object of the present invention is to provide a system and method for delivering successive lengths of a continuous cloth to a spreading table to be stacked with one edge of each of the spread lengths in vertical alignment.

Still another object of the invention is to substantially reduce down time.

Yet another object of the invention is to increase the rate at which cloth can be spread and stacked.

Yet another object of the invention is to a provide a feed and supply assembly which delivers a cloth to a spreading machine under controlled tension from a stationary supply.

Another object of the invention is to provide a reciprocating cloth delivery and support structure which supports the cloth and delivers it to the spreading machine from a stationary supply.

Another object of the invention is to provide an edge control mechanism which delivers one edge of the cloth from a stationary supply to the spreading table along a single vertical plane.

Another object of the invention is to provide a cloth spreading arrangement in which the cloth is supplied from a stationary mounted cloth roll.

Another object of the invention is to provide a cloth spreading arrangement in which the cloth is supplied from a stationary supply of folded fabric.

SUMMARY OF THE INVENTION

The present invention is directed to a cloth spreading system which includes a spreading table on which layers of cloth are stacked in a flat and vertical manner and a cloth spreading machine which is operative to reciprocate along the spreading table and deliver the cloth onto the table. The cloth is delivered from a stationary cloth supply which is arranged adjacent to the spreading table. A cloth support and delivery assembly delivers the cloth from the stationary supply to the spreading machine during the reciprocal movement thereof. The support and delivery assembly includes a stationary track arranged above the spreading table. A roller bed is supported for reciprocating movement by the track. A drive mechanism drives the roller bed over the track in synchronism with the reciprocating movement of the spreading machine. Preferably, the roller bed is driven by a drive connection between the roller bed and the travelling spreading machine. The roller bed consists of spaced and interconnected rollers arranged transversely of the spreading table. There is also a drive arrangement for rotating the rollers of the roller bed in synchronism with the movement of the spreading machine so that the rotating rollers may assist in moving the cloth over the roller bed. The drive arrangement is mounted adjacent one of the track members which support the roller bed.

The roller bed includes spaced hollow rollers carried by axles which have roller bearings at each end. The roller bearings rotate over the track members during reciprocal motion of the roller bed. The drive means comprises a resilient friction bar arranged to be in pressure contact with the transverse rollers. Movement of the roller bed causes the rollers to rotate about the axles. Preferably, one end of the roller bed is connected with the spreading machine which acts to reciprocate the roller bed to provide the synchronized drive mechanism.

An edge guide and alignment assembly includes transversely arranged and automatically adjusted guide rolls carried by the cloth spreader. The alignment apparatus receives the cloth from the delivery and support assembly and delivers it along a constant vertical line to the laying rolls of the cloth spreading machine which spread and stack the cloth on the spreading table in layers wherein the edges of the cloth generally all lie in a common plane. The edge alignment assembly includes a frame which is pivotally mounted on the spreading machine. The frame is mounted for arcuate movement and carries the guide rolls. A guide roll drive is connected with the frame and is operative to accurately position the guide rolls in response to a sensor element. The sensor element senses the edge of the fabric as it travels along a substantially vertical path to the spreading rolls of the spreading machine. The sensor acts to control the drive to arcuately position the guide rolls to maintain the position of the cloth edge in a constant position during its delivery to the spreading table.

The cloth supply may comprise a stationary supply truck on which an endless cloth is flat folded. Guide rolls guide the cloth from the supply truck to the support and delivery assembly. Alternatively, the cloth supply may comprise a stationarily mounted cloth supply roll and an accumulator bin to which the cloth is delivered from the supply roll, and from which the cloth is withdrawn. The alternative arrangements require a sensor to activate a cloth roll drive associated with the cloth supply roll to deliver cloth to the accumulator bin when necessary so that the supply of cloth in the accumulator bin is maintained within limits.

In operation, longitudinal movement of the spreading machine away from the stationary cloth supply draws cloth from the supply. The withdrawn cloth passes over and is supported by the support and delivery assembly with a portion of the cloth being delivered to the spreading machine and spread onto the spreading table. Longitudinal movement of the spreading machine back toward the cloth supply, delivers the cloth to the cloth spreader only from the support and delivery assembly, not the stationary supply.

The invention also includes a method of spreading cloth on a spreading table which includes providing a stationary cloth supply; and reciprocating a cloth spreader along a spreading table and delivering the cloth to the cloth spreader from the stationary supply during each reciprocation thereof. The cloth is delivered from the cloth supply only on alternate reciprocations of the cloth spreader, and onto the spreading table in a flat length. Next, the method includes stacking successive lengths of the cloth vertically with at least one edge of each length being aligned, and withdrawing cloth from the stationary supply at one rate of speed and delivering the cloth onto the spreading table at another rate of speed.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1A is a sectional end view of the cloth edge sensing and guiding apparatus;

DESCRIPTION OF A PREFERRED EMBODIMENT

Figure 1:
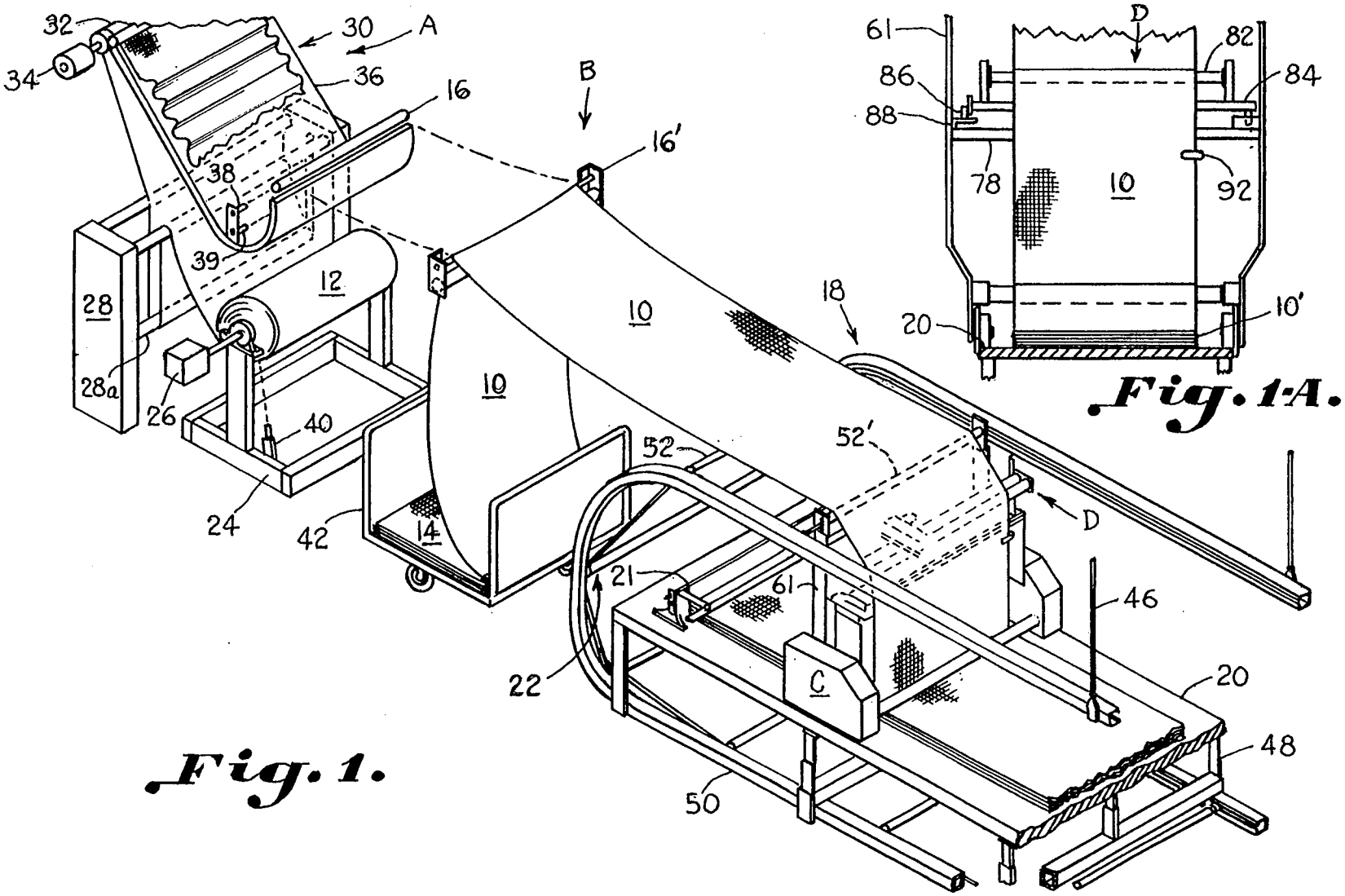
FIG. 1 is a partial perspective view of the cloth spreading system of the invention.

Referring now to the drawings, a cloth spreading system according to the invention will now be described in more detail. As can best be seen in FIG. 1, the cloth spreading system includes a stationary supply, designated generally as A or B, which stores cloth 10 in the form of a roll 12 or folds 14. From stationary supply A or B cloth 10 is passed as a continuous sheet over a direction roll 16, and/or an adjustable bow bar 16' onto an overhead support and delivery assembly, designated generally as 18, which provides a means of supporting and delivering the cloth from the stationary supply to cloth spreading machine C. Bow bar 16' assists in centering the cloth onto the support and delivery system. For this purpose, the bow of the bar may be adjustable. The cloth spreading machine C is mounted on a cloth spreading table 20 to reciprocate longitudinally thereof in usual self propelled fashion. Cloth spreading machine C, the drive and table alignment system for the machine, and the cloth spreading table 20 may be of usual construction and form no part of the present invention except for the modifications to the spreading machine as set forth here later. A suitable cloth spreading machine manufactured by Eastman Machine Company, Inc. of Buffalo, New York is suitable for adaptation to the present cloth spreading system and invention. However, it is believed that a spreading machine by any manufacturer could be utilized. Since the details of such spreading machines and tables are already known, only those details that are necessary for an understanding of the invention will now be described.

Figure 5:
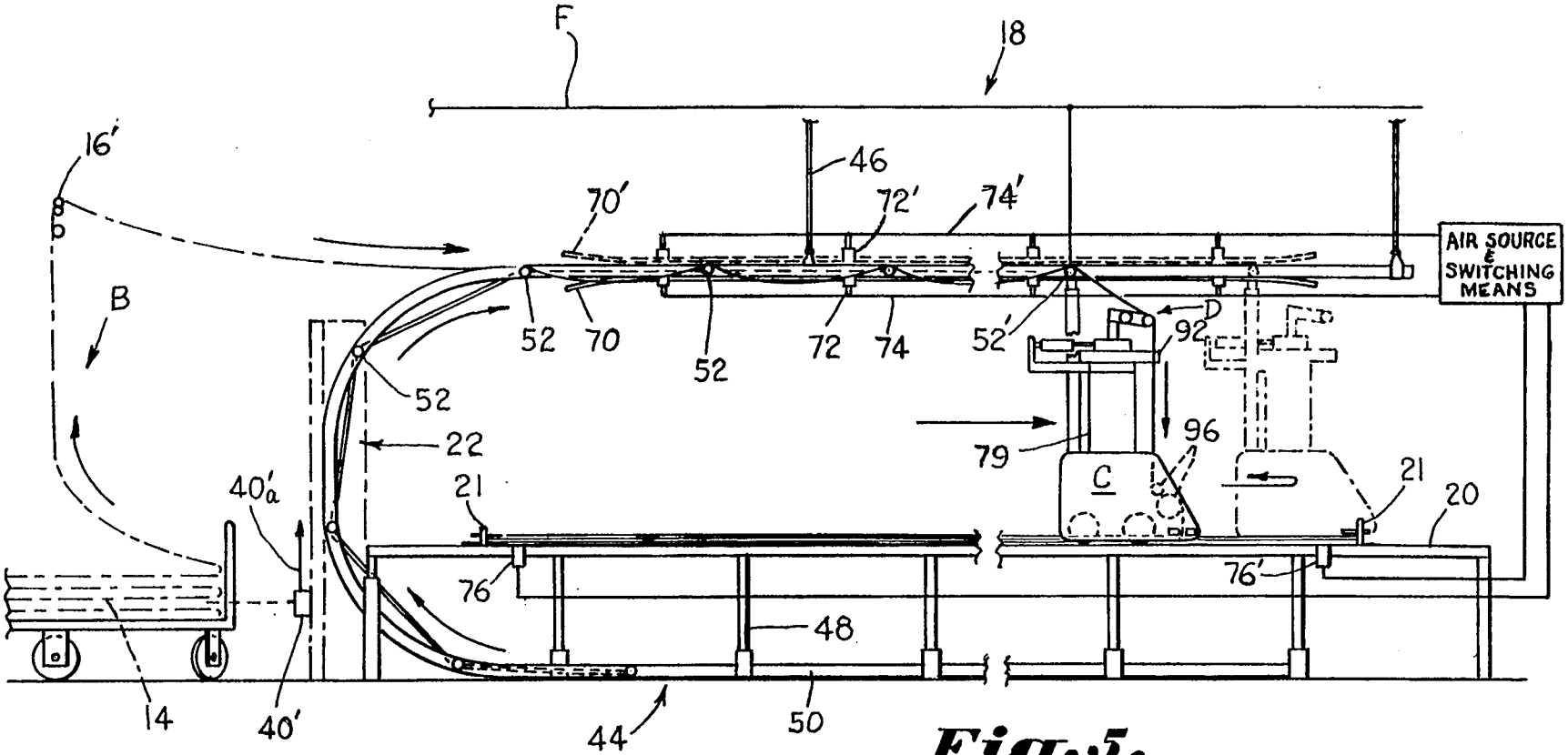
Figure 6:
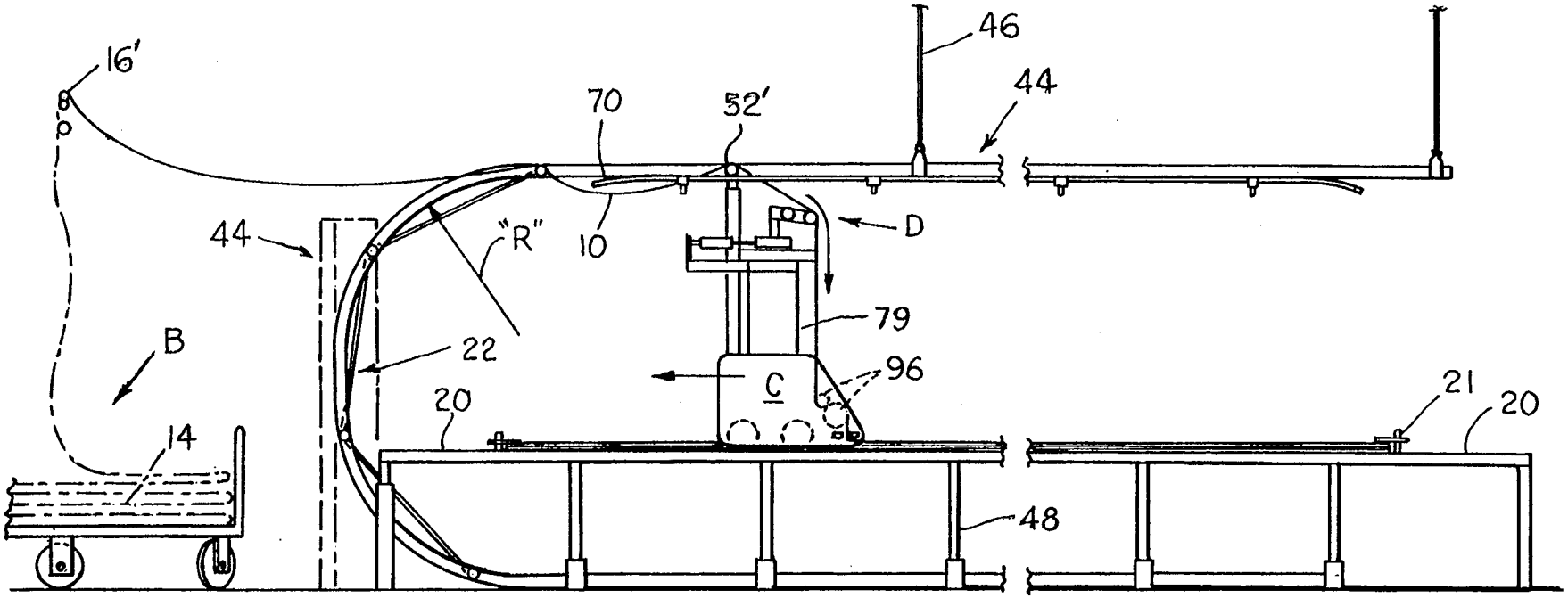

Connected with cloth spreading machine C is a cloth supporting roller bed, designated generally as 22, which forms a part of support and delivery system 18. As the spreading machine moves forward and away from the cloth supply end of spreading table 20, the machine draws cloth 10 and roller bed 22 with it. When the cloth spreading machine returns to the supply end of spreading table 20, roller bed 22 is retracted beneath the spreading table (FIGS. 4, 5, 6).

Figure 4:
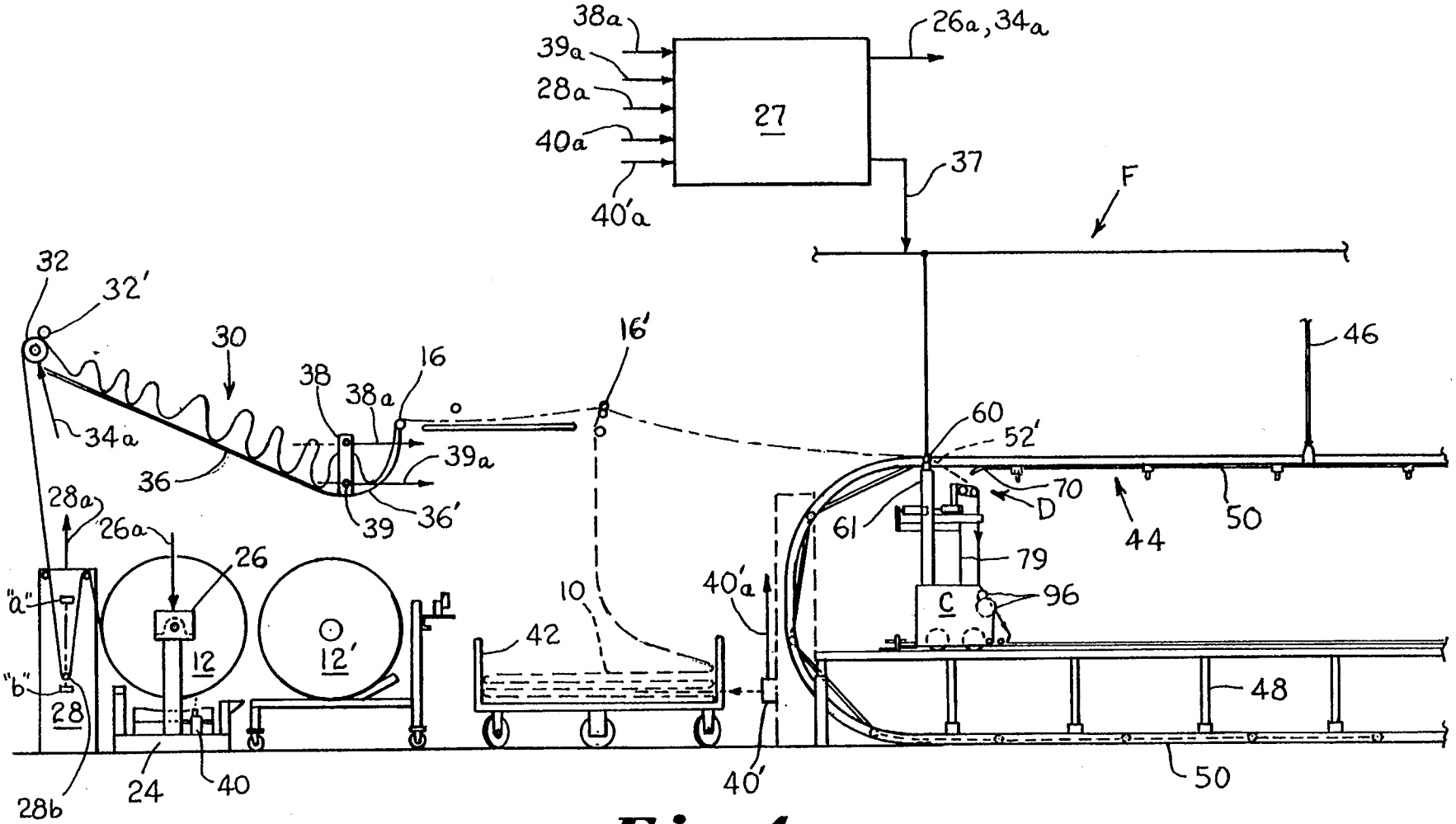
FIG. 4, FIG. 5, and FIG. 6 are side elevations showing the spreading machine and roller bed in various operating positions on the spreading table.

Fabric supply A, as seen in FIGS. 1 and 4, will now be described in more detail. A support stand 24 is arranged to support and rotate a cloth roll 12. A cloth roll drive includes a support shaft **12*a* for cloth roll 12, and a motor 26 to rotate the shaft. A controller 27 controls motor 26. Controller 27 may include a conventional motor controller and a programmed logic controller which controls the motor control. Adjacent support stand 24 is a dancer roll assembly 28 which includes a dancer roll 28*b* and a pair of guide rolls. Dancer roll assembly 28 generates a reference speed signal 28*a*, and provides a means for synchronizing the speed and drive of cloth roll 12 and the drive of a feed roll 32 (described below). This synchronizes the rate of linear fabric travel between the rolls. Reference speed signal 28*a* is transmitted to controller 27. For this purpose, dancer roll 28*b* is mounted in a slot, as represented by dotted lines, and moves between limit switches "a" and "b". The position of dancer roll 28*b* in the slot depends on the drive condition of cloth supply roll 12 or feed roll 32. For example, if feed roll 32 is delivering cloth faster than the cloth is being supplied by cloth roll 12, the dancer roll will move upwards. This will generate a signal 28*a* delivered to controller 27 which will generate corresponding signals 26***a* and 34*a* to adjust the speed of one or both of the cloth roll or feed roll to return the dancer roll to its neutral position. For example, if the dancer roll assembly moves upward the speed of the cloth supply roll may be increased to supply more cloth causing dancer roller 28*b* to move downward. In the event, the dancer roll assembly hits upper limit switch "a", a signal will be generated to stop the drive of feed roll 32 while supply roll 12 catches up. Alternately, if lower limit switch "b" is hit by the dancer roll assembly, rotation of cloth supply roll 12 may be stopped until further cloth is needed. The dancer roll assembly may be any suitable, conventional assembly.

Figures 2, 3:
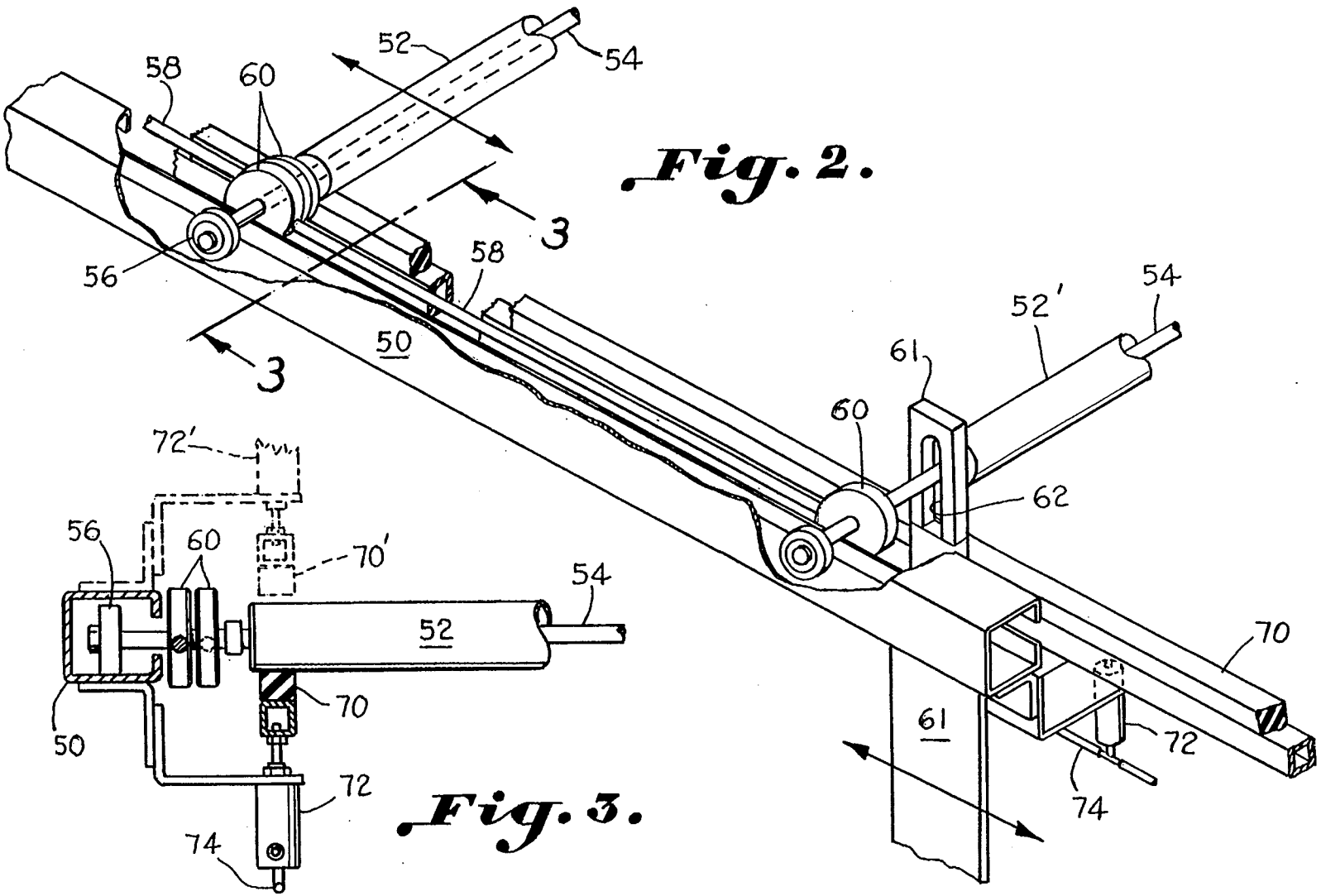
FIG. 2 is a partially cut away perspective view showing the guide track and roller bed structures.
FIG. 3 is a sectional end view taken along line 3—3 of FIG. 2.

As can best be seen in FIG. 2, a cloth accumulator, designated generally as 30, is arranged adjacent and down stream of dancer roll assembly 28. A pair of feed rolls 32, 32' form a nip to deliver cloth 10 from the dancer roll assembly to an accumulator bin 36. Feed roll 32 is driven, and roll 32' is an idler roll driven by contact with roll 32. Associated with feed roll 32 is a feed roll drive which includes a shaft 32*a* to support the feed roll, and a motor 34 to rotate the shaft. Controller 27 controls operation of motor 34 and 26 via motor control signals 26*a*, 34*a* in a manner to be described below. Accumulator bin 36 is J-shaped with a long arm and a short arm interconnecting to form a trough 36'. Drive rolls 32, 32' are arranged adjacent the end of the long arm while guide rolls 16, 16' are arranged adjacent the end of the short arm. A conventional photo electric sensor 38 is arranged along an edge of accumulator bin 36 and arranged to sense an amount of cloth stored in the trough of the accumulator bin. In operation, when sensor 38 senses a need for cloth in the bin, the sensor generates a signal 38*a* transmitted to controller 27 which generates motor control signals 26*a*, 34*a* and causes the respective rolls to be rotated and feed cloth. Cloth 10 is fed to dancer roll assembly 28 as cloth roll 12 is rotated simultaneously. The cloth is drawn through dancer roll assembly 28 by feed rolls 32, 32' and delivered onto the long leg of accumulator bin 36 where it collects in folds in trough 36'. When bin 36 is filled sufficiently with cloth, sensor 38 de-activates drive motors 26 and 34. Should for any reason sensor 38 fail to keep a supply of cloth in accumulator bin 36, a second photo electric sensor 39 arranged in trough 36' senses an empty condition and sends a signal 39*a* to controller 27 which sends a signal 37 which deactivates the power source signal over bus line F which stops the operation of cloth spreading machine C. For example, the cloth on cloth roll 12 may be depleted, making it impossible to fill bin 36. First sensor 38 and second sensor 39 define cloth sensor means for maintaining a desired quantity of cloth in the bin.

A photo electric sensor 40 may be arranged to sense the supply of cloth on roll 12. When the supply of cloth on roll 12 is depleted, sensor 40 transmits a signal 40*a* to controller 27 which deactivates drive motors 26 and 34 and also activates an alarm or signal device which alerts operators to change roll 12. Alternatively, sensor 40 may be arranged to cause the entire system to shut down upon detecting the depletion of cloth roll 12. As shown in FIG. 4, when cloth roll 12 become empty it will simply be removed from stand 24 and replaced with a replacement cloth roll 12'. The leading end of cloth from roll 12' is attached to the trailing end of cloth from roll 12 so that cloth 10 remains a unitary piece. Any known attaching means may be employed such as stitching with a cross-rail machine or gluing.

As cloth 10 leaves accumulator 30 via directional roll 16, it is directed to the support and delivery system 18 by bow bar 16'.

Alternative supply B shown in FIGS. 1, 4, and 5 is much simpler than supply A. In B, a cloth truck 42 is filled with folds 14 of cloth 10 and is stationed near the supply end of spreading table 20. The free end of cloth 10 is passed over bar 16' and directed to the support and delivery system 18 from which it passes to cloth spreading machine C. A conventional photo electric sensor 40' is suitably arranged adjacent the location in which cloth truck 41 is positioned to sense the quantity of cloth folds 14 remaining on the truck and generates a signal 40'*a*. When folded cloth stack 14 is depleted sufficiently sensor 40 generates the signal indicating re-supply is necessary. In this arrangement, the empty cloth truck is removed and a replacement cloth truck filled with flat folded cloth is positioned adjacent the end of spreading table 20. The leading and trailing ends of cloth 10 are attached as earlier described and cloth 10 continues to be supplied as a single piece. Here also, sensor 40' may be arranged to deactivate the entire cloth spreading system during re-supply by signaling controller 27. Sensors 38, 39, 40, and 40' may be conventional retro-reflective sensors. From directional rolls 16, cloth 10 passes to support and delivery system 18 from which it is passed on to the cloth spreading machine C.

Support and delivery assembly 18 includes a C-shaped guide frame 44 best seen in FIGS. 1–5. Guide frame 44 includes a pair of tracks 50 which, in the illustrated embodiment, have a C-shaped cross-section and which are arranged to extend by equal distances over and under opposite edges of spreading table 20 and about one end thereof. The position of tracks 50 above the cloth spreading table is maintained by supports 46 which attach with suitable support ceiling structure. The position of tracks 50 extending below spreading table 20 is supported by table legs 48. Roller bed 22 is carried by guide frame 44. As can best be seen in FIGS. 3 and 4, the roller bed consists of a plurality of spaced hollow rollers 52 carried by axles 54. Opposed ends of axles 54 carry roller bearings 56 which are received in the interior of C-shaped tracks 50. Longitudinal links 58 interconnect and space transverse axles 54 in prescribed relationship through bushings 60 attached to opposite ends thereof. The spacing between the rollers is preferably less than the radius of curvature "R" of guide frame 44 (FIG. 6). This provides smooth roller bed reciprocation. Preferably, the spacing is between 6 and 48 inches. Between bushings 60, roller 52 is rotably mounted with axle 54 by suitable bearings (not shown). The axle 54 of an end most roller 52' on the roller bed, is received through slot 62 of an extension of a stanchion 61 to connect roller bed 22 with the cloth spreading machine. This drive connection provides a means for synchronized drive between the roller bed movement and spreading machine movement. For this purpose, stanchion 61 is attached to upstanding legs 79 of spreading machine C by any suitable means such as welding. During the reciprocal forward and return movements of cloth spreading machine C the roller bed is drawn along guide frame 44 in direct response to the movement of the cloth spreading machine to extend from almost completely under the spreading table to almost completely over the spreading table in alternating passes.

In order that the delivery of cloth 10 over the roller bed might be assisted, rollers 52 are preferably rotably driven. The mechanism for driving rollers 52, best seen in FIGS. 2, 3, and 5, consist of an elongated friction bar 70 which is mounted to extend along one of the guide tracks 50 in position to contact an edge surface of rollers 52 as they pass over spreading table 20. Friction bar 70 is formed of a suitably coarse elastic synthetic material which is secured to a metal backing strip and is carried by a plurality of spaced conventional pneumatic cylinders 72. Air is supplied to cylinders 72 via supply lines 74 from a suitable source. In the preferred embodiment, cylinders 72 which are secured to a track by suitable frame structure, are controlled to constantly urge friction bar 70 with sufficient force into contact with the outer surface of rollers 52. Movement of the roller bed causes rollers 52 to rotate toward the direction of movement of the roller bed. End most roller 52', which provides a drive connection to the spreading machine does not rotate. In this arrangement, as cloth spreading machine C moves away from the cloth supply station drawing the cloth with it over roll 16 or 16' onto roller bed 22 and over rollers 52. During this motion, rollers 52 rotate in the direction of movement of roller bed 22 (clockwise) and assist in the advancement and delivery of the cloth. During the subsequent, reverse movement of the cloth spreading machine towards the supply end, cloth fed to the cloth spreading machine is not drawn from the supply, but is only withdrawn from the roller bed. During this phase, because no cloth is drawn from supply A or B, it is usually desirable to supply some additional tension to the cloth to compensate for the resulting lack of tension which is present on the cloth when drawn off from the supply during movement away from the supply. Rollers 52, which are rotating in the reverse direction (counter clockwise) during the return cycle of the spreading machine, and in the direction of the movement of roller bed 22, but against the direction of cloth advancement during the return cycle, act to provide a slight tension to cloth 10.

Should the texture of the cloth being spread require that a delivery assist is necessary in both directions of the roller bed, the rollers 52 can be driven, in the illustration embodiment, clockwise in both directions of the roller bed. For this purpose the drive for rollers 52 can be altered to include an additional friction bar 70' which is arranged on the opposite side of rollers 52 as shown in FIGS. 3 and 5 in broken lines. Friction bar 70' is carried by conventionally operated pneumatic cylinders 72' which are supplied by supply line 74'. An air source and switch mechanism 73, shown in FIG. 5, is arranged between air supply lines 74, 74'. Mechanism 73 may be any conventional solenoid operated air valve arrangement connected to a suitable air supply, and electrically controlled by the sensors. Sensors 76, 76' are arranged at opposite ends of the spreading table. Prior to movement of the cloth spreading machine C in the direction shown in FIG. 5, sensor 76 is activated to switch the supply of air to cylinders 72 so that friction bar 72 is position to drive rollers 52 in the direction of movement of cloth 10 and cloth spreading machine C. Upon reaching sensor 76' and prior to movement of cloth spreading machine in the opposite direction, as shown in FIG. 6, sensor 76' activates switching mechanism 73. This directs air through line 74' to cylinders 72' which places friction bar 70' in contact with rollers 52. In this instance, rollers 52 are driven in the direction of movement of cloth 10 and opposite to the direction of movement of spreading machine C. By so causing rollers 52 to always rotate in the same (clockwise) direction, the delivery of cloth 10 to the cloth spreading machine C is always assisted. It is noted that cylinders 72, 72' carrying friction bars 70, 70' retract when the air supply is diverted away from them. When cylinders 72, 72' are retracted friction, bars 70, 70' are in an inactive position out of contact with rollers 52. Air cylinders 72, 72' may be any conventional one-way, spring returned air actuated cylinders.

A cloth edge guide assembly, best seen in FIGS. 1, 1A, 5, 7, 8, and 9, is mounted with the cloth spreading machine C which provides a means for guiding and aligning a cloth edge in vertical stacked layers. This provides a modification to a conventional spreading machine which facilitates transition of the cloth from the overhead support and delivery means to the layering rolls 96 of the spreading machine. There is an edge guide D means mounted adjacent to and forward of stanchion 61 which consists of a mounting frame 78 extending across and secured to upstanding legs 79 of cloth spreading machine C. Upstanding legs 79 are normally utilized to support a cloth roll on conventional spreading machines. In the illustrated embodiment, mounting frame 78 carries roller frame 80 which includes two guide rolls 82, 82' positioned below and slightly forward of end roller 52'. One end of roller frame 80 is pivotally mounted at 84 to mounting frame 78. The opposite end of roller frame 78 is provided with support wheels 86 which rest on and reciprocate in guide 88 of mounting frame 78. A drive, in this instance a pneumatic motor 90, is carried by mounting frame 78 and is connected with roller frame 80. At least one guide roll, such as 82, is needed to provide directing means for directing cloth from the overhead support to layering rolls 96 of the spreading machine.

Figure 7:
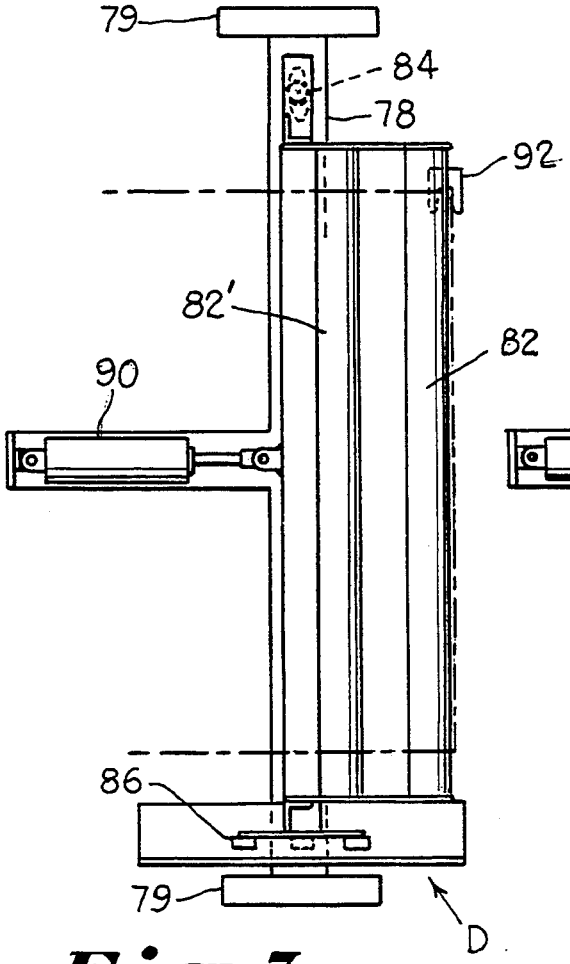
FIG. 7 and FIG. 8 are top plan views showing the mechanism cloth guiding and edge aligning mechanism.
Figure 8:
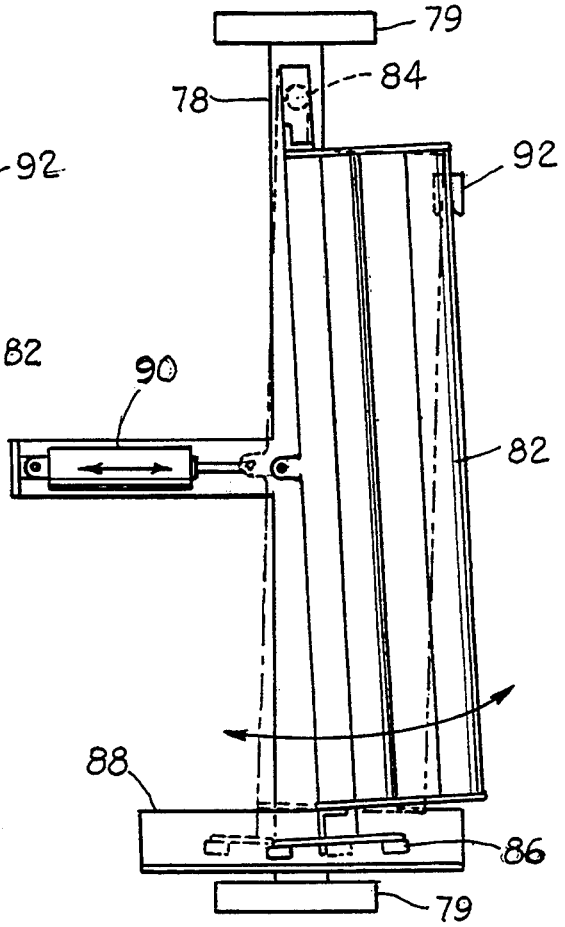
Figure 9:
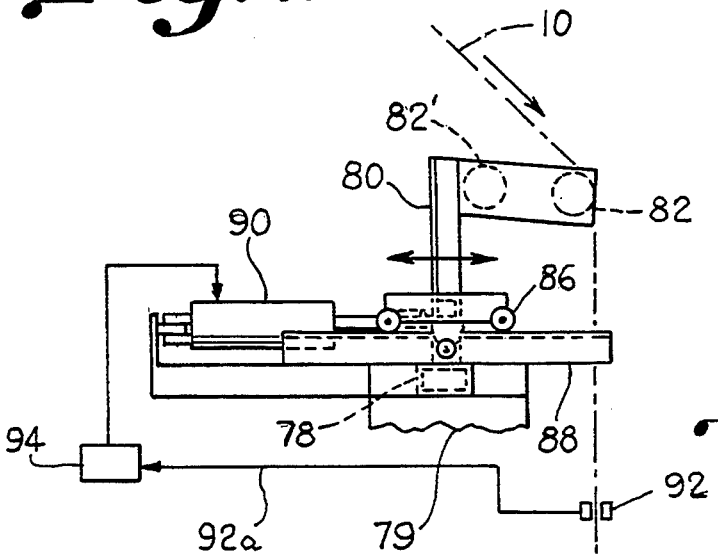
FIG. 9 is a partial side elevation illustrating the cloth guiding and aligning mechanism.

An infra-red edge sensor 92 is positioned below and adjacent one edge of guide roller 82, 82'. The edge sensor is designed to detect the horizontal location of one edge of fabric 10 as it passes from guide roller 82 vertically downward to cloth laying rollers 96 of cloth spreader C. Should the edge of cloth 10 deviate to the left or right during its passage to laying rollers 96, edge sensor 92 will send an appropriate signal 92*a* to control 94 (a signal processor e.g. amplifier) which causes a servo linear actuator 90 to arcuately shift mounting frame 78 along a horizontal plane in the appropriate direction about axis 84 to re-align the longitudinal axis of roll 82 relative to the vertical axis of the sensed edge of cloth 10. This causes the cloth to shift laterally during its movement over roll 82 as shown in FIGS. 7 and 8. In this manner, the axial alignment of the edge of cloth 10 passing through sensor 92 is maintained constant in its passage to cloth spreading machine C, thus allowing laying rollers 96 to stack the layers of cloth on spreading table 20 with one edge 10' of cloth 10 arranged to be vertically aligned as shown in FIG. 1A. Edge 10' thus includes each edge of a cloth layer in the stack lying in a generally common plane.

It is noted that roller frame 80 carries two guide rolls 82, 82' which are laterally spaced while the drawings show cloth 10 passing over only guide roll 82. Rolls 82, 82' when used together increase the drag on cloth 10 during its passage to spreading machine C. Certain types of fabric, particularly very fine fabrics, are more effectively controlled with more drag applied during spreading. More course fabrics, such as denim, are effectively controlled via a single guide roll as shown in the drawings.

In practice, the conventional spreading table 20 which has conventional cloth clamps 21 arranged at each end of the path covered by the cloth spreading machine C is provided for use with the cloth spreading system of the invention. The cloth spreading machine is also conventional and is powered by the usual overhead power feed F and driven in the usual reciprocal manner over spreading table 20. The support and delivery system 18 is arranged adjacent spreading table 20 with guide frame 44 which carries roller bed 22 being positioned over, under and adjacent one end of the spreading table. Cloth edge guiding system D is mounted on cloth spreading machine C to replace the usual cloth roll support and feed system. One end of roller bed 22 is connected with cloth spreading machine C to move in response with the movement thereof. A stationary cloth supply system, for example supply system A, is arranged adjacent support and delivery system 18. Cloth supply roll 12 is activated to supply cloth to accumulator 30 from which it passes to supply and delivery system 18, then through edge guiding system D and to laying rollers 96 of cloth spreader C.

In operation, as cloth spreading machine C moves away from supply A during a forward cycle, cloth 10 is drawn from accumulator 30 at twice the rate it is spread on spreading table 20. Generally half of the cloth is spread on the tables on the forward cycle, and the additional fabric 10 is supported by roller bed 22 and spread on the return cycle. The roller bed is moved into position over spreading table 20 by the movement of the cloth spreading machine C. Upon completing its forward traverse of spreading table 20 away from supply A, spreading machine C returns back to the stationary supply. During this traverse, roller bed 22 passes over and begins to move under cloth spreading table 20. As the spreading machine pushes roller bed along track 44 and under spreading table 20, cloth 10, which was being supported by the roller bed, is delivered to the spreading machine to be spread onto the stack of cloth on the spreading table. During this pass, no cloth is removed from accumulator system 30. The process is repeated until the desired amount of cloth is spread on spreading table 20.

The overhead cloth support and delivery assembly may be utilized to stack cloth face to face in the case where the cloth layers are folded at the ends and clamped by clamps 21. Alternately, when it is desired to stack the cloth layers with the faces disposed in the same direction, a reverse driven feed roll may be utilized to take up the additional amount of cloth supported on the roller bed as the roller bed mover toward the supply during the return cycle. This is because the spreading of the cloth on the return cycle may be omitted in order to lay the cloth facing in the same direction. Other methods and manners of spreading the cloth in different arrangements may also be utilized as will become readily apparent to the average artisan having been taught the expedient of the present invention.

Thus it can be seen an advantageous construction can be had for a cloth feeding system for use with a cloth spreading system or other associated cloth handling equipment wherein cloth from a stationary supply may be replenished without stopping the equipment by utilizing an overhead cloth support and delivery assembly which guides cloth from the stationary supply and delivers the cloth to a cloth spreading machine or the like equipment. By utilizing a roller bed having driven rollers, the tension of the cloth may be controlled as the cloth is spread and stacked in layers for uniform cutting or other operation on the cloth. By utilizing a stationary supply, larger, continuous quantities of cloth may be utilized. In particular, large quantities of folded cloth may be utilized on a cloth truck as a stationary supply. In this case, re-rolling of the cloth before spreading and cutting operations is not needed. This eliminates the making of cloth roll beams. Since larger continuous quantities of cloth may be utilized, the amount of waste is significantly reduced as often occurs when large numbers of small rolls are utilized which must be pieced together. For example, in the present invention, one or two large rolls, or supply trucks may be utilized for denim cloth where previously ten to twelve small rolls are needed. This means that twelve piecing operations may be eliminated as is needed when utilizing small rolls. The present invention makes it highly attractive to locate the cutting operation at the mill where the cloth is being produced since re-rolling of the cloth is not necessary before cutting.

While a preferred embodiment of the invention has been described using specific terms, such description is for illustrative purposes only, and it is to be understood that changes and variations may be made without departing from the spirit or scope of the following claims.

What is claimed is:

1. In a cloth spreading system for spreading layers of cloth in a stack on a spreading table, said layers of cloth being stacked on said spreading table in a flat and generally vertical manner by a spreading machine operative to reciprocate along said spreading table, a cloth feed system comprising:

a stationary cloth supply disposed near said spreading table;

an overhead cloth support and delivery assembly for delivering and guiding said cloth from said stationary supply in a continuous piece to said spreading machine during said reciprocal movement thereof;

said overhead support and delivery assembly includes a stationary track arranged over substantially the entire length of said spreading table and a roller bed supported by said track for synchronous reciprocating movement with said spreading machine;

said roller bed including spaced and interconnected rollers arranged transversely of said spreading table and a drive for rotating said rollers in synchronism with movement of said spreading machine to assist movement of said cloth over said roller bed, said roller drive including a first resilient friction bar carried by said stationary track, said friction bar being arranged to be in pressure contact with said transverse rollers whereby;

movement of said roller bed may cause rotation of said rollers.

2. The spreading system of claim 1 wherein pneumatic actuators mount and urge said first friction bar into position to engage said rollers so that said rollers are driven in the direction of movement of said roller bed.

3. The spreading system of claim 1 wherein said first friction bar is adjacent said stationary track above said roller bed and a second friction bar is arranged adjacent said stationary track below said roller, first and second pneumatic members respectively connected with said first and second friction bars and adapted to position each said friction bar in a first roller engaging position and a second roller non-engaging position, a control adapted to actuate said first pneumatic member to move said first friction bar to said first position while causing said second friction bar to be maintained in said second position during movement of said spreading machine in one direction and to actuate said first pneumatic member to move said first friction bar to said second position while causing said second pneumatic member to move said second friction bar to said first position during movement of said spreading machine in an opposite direction; whereby, said rollers are driven to rotate in a single direction during reciprocal movement of said roller bed.

4. A cloth spreading system comprising:

a spreading table on which a sheet of cloth is stacked in layers in a flat and generally vertical manner;

a cloth spreading machine operative to reciprocate along said spreading table to deliver said cloth onto said table;

a stationary cloth supply arranged near said spreading table;

a support and delivery assembly guiding said sheet of cloth from said stationary supply to said spreading machine during reciprocal movement thereof;

said support and delivery assembly including a roller bed operating in synchronism with said spreading machine, said roller bed including interconnected rollers arranged in fixed spaced relationship transversely of said spreading table and a roller drive for rotating said rollers in synchronism with movement of said spreading machine to assist movement of said cloth over said roller bed.

5. The cloth spreading system of claim 4 including a stationary track arranged above, below and around at least one end of said spreading table supporting said roller bed for reciprocating movement, a roller bed drive driving said roller bed along said track in synchronism with said reciprocating movement of said spreading machine whereby, during movement of said spreading machine away from said cloth supply said cloth is drawn onto and over said roller bed and delivered onto said spreading table, and during movement of said spreading machine towards said cloth supply said cloth is removed from said roller bed and delivered onto said spreading table.

6. The cloth spreading system of claim 4 wherein a pair of U-shaped track members support said roller bed, said track members being arranged over and under said spreading table, and said roller drive being arranged adjacent at least one of said track members.

7. The cloth spreading system of claim 6 wherein axles having roller bearings at opposite ends thereof mount said rollers, said roller bearings being adapted to rotate along said track members during reciprocal movement of said roller bed.

8. The cloth spreading system of claim 6 wherein said roller drive comprises at least one resilient friction bar carried adjacent one of said track members, said friction bar being arranged to be in pressure contact with said transverse rollers whereby, movement of said roller bed causes rotation of said rollers.

9. The spreading system of claim 8 wherein pneumatic actuators mount and urge said friction bar into position to engage said rollers so that said rollers are driven in the direction of movement of said roller bed.

10. The spreading system of claim 8 wherein a first friction bar is adjacent said track member above said roller bed and a second friction bar is arranged adjacent said track member below said roller bed, first and second pneumatic motors respectively connected with said first and second friction bars and adapted to position each said friction bar in a first roller engaging position and a second roller non-engaging position, a control adapted to actuate said first of said pneumatic actuators to move said friction bar to said first position while causing said second friction bar to be maintained in said second position during movement of said roller bed in one direction and to actuate said first of said pneumatic motors to move said friction bar to said second position while causing said second of said pneumatic motors to move said second friction bar to said first position during movement of said roller bed in an opposite direction; whereby, said rollers are caused to rotate in a single direction during reciprocal movement of said roller bed.

11. The cloth spreading system of claim 4 wherein said rollers are spaced longitudinally at between 6" and 48".

12. The cloth spreading system of claim 4 wherein a connector connects said roller bed at one end with said cloth spreading machine whereby said roller bed drive includes said cloth spreading machine.

13. The spreading system of claim 12 wherein said connector includes a pair of stanchions connected with and carried by said cloth spreading machine said stanchions being connected with an axle carrying an end roller of said roller bed.

14. The spreading system of claim 13 wherein said end roller is rotatably driven by movement of said cloth spreading machine and acts to assist in directing said cloth from said roller bed to said cloth spreading machine.

15. The cloth spreading system of claim 4 wherein said stationary cloth supply comprises a supply truck containing a large supply of flat folded cloth and at least one guide roll over which said cloth is guided from said supply truck to said support and delivery assembly.

16. The cloth spreading system of claim 4 wherein said cloth supply comprises a cloth supply roll, a cloth roll drive, and an accumulator to which said cloth is delivered from said supply roll and from which said cloth is withdrawn by said cloth spreading machine.

17. The spreading system of claim 16 including a cloth roll sensor arranged near said cloth supply roll which acts to stop said cloth spreading machine upon depletion of said cloth supply roll.

18. The spreading system of claim 16 wherein said accumulator includes at least one driven feed roll which feeds said cloth, a feed roll drive for driving said feed roll to feed cloth at a rate which exceeds the rate at which said cloth is withdrawn, and cloth sensors operative to sense the accumulated cloth in said accumulator and to provide control of said feed roll drive and said cloth supply roll drive in response to said sensing.

19. The cloth spreading system of claim 18 wherein said cloth sensors includes a first sensor operative to activate said feed roll and cloth roll drives to deliver said cloth to said accumulator to maintain a desired cloth quantity within said accumulator.

20. The cloth spreading system of claim 19 wherein said cloth sensors include a second sensor operative to deactivate said cloth spreading machine when said cloth in said accumulator drops below said limits.

21. A spreading system for spreading a continuous sheet of cloth in flat, aligned and vertically arranged layers on a spreading table comprising:

a self propelled reciprocally driven spreading machine mounted for movement on said spreading table;

a stationary supply of cloth arranged near one end of said spreading table for supplying cloth to said spreading machine;

a cloth support and delivery assembly arranged to cooperate with said spreading machine and said supply of cloth, said support and delivery assembly acting to support and deliver cloth drawn from said supply of cloth to said spreading machine;

a guide arranged longitudinally of said spreading table supporting said support and delivery assembly for movement synchronous with said movement of said spreading machine on said spreading table; whereby, upon movement of said spreading machine and said supply and delivery assembly away from said cloth supply, cloth is drawn from said supply, supported by and drawn over said support and delivery assembly with a portion of said drawn cloth being delivered to said spreading machine and spread on said spreading table and upon movement of said spreading machine and said supply and delivery assembly toward said cloth supply, cloth is delivered to said spreading machine and spread on said spreading table solely from said support and delivery assembly.

22. The cloth spreading system of claim 21 wherein said cloth spreading machine carries an edge alignment device, said edge alignment device including at least one transversely arranged and angularly adjustable guide roll which receives said cloth from said support and delivery assembly and directs said cloth to said cloth spreading machine to stack said cloth in layers with edges of the cloth lying in a common plane.

23. The cloth spreading system of claim 22 wherein said at least one guide roll is carried by a frame pivotally mounted with said cloth spreading machine; and a guide roll drive connected with said frame being operative to arcuately move said frame in response to the position of said edge of said cloth.

24. The cloth spreading system of claim 23 wherein said edge alignment device includes a sensor carried forward of said guide roll, said sensor sensing said one edge of said cloth during delivery thereof and acting to actuate said guide roll drive to maintain the position of said edge of said cloth along a prescribed line during delivery of said cloth from said guide roll to said cloth spreading machine.

25. In a cloth spreading system for spreading layers of cloth in a stack on a spreading table, said layers of cloth being stacked on said spreading table in a flat and generally vertical manner by a self propelled spreading machine operative to reciprocate along said spreading table, said spreading machine having laying rollers which deliver said cloth onto said table; a cloth feed system comprising:

a stationary cloth supply disposed near said spreading table;

an overhead cloth support and delivery assembly for delivering and guiding said cloth from said stationary supply in a continuous piece to said spreading machine during said reciprocal movement thereof;

said overhead support and delivery assembly includes a stationary track arranged above said spreading table over substantially the entire length of said spreading table; and a roller bed supported for reciprocating movement by said track including a plurality of spaced rollers; and a directing mechanism for directing said continuous piece of cloth from said support and delivery assembly to said laying rollers of said spreading machine.

26. The system of claim 25 including a roller bed drive driving said roller bed along said track in synchronism with said reciprocating movement of said spreading machine so that during movement of said spreading machine away from said cloth supply, said cloth is drawn over said roller bed and delivered onto said spreading table and during movement of said spreading machine towards said cloth supply said cloth is removed from said roller bed and delivered onto said spreading table.

27. The system of claim 26 wherein said roller bed drive includes an upstanding frame carried by said spreading machine and a drive connector connecting said frame to said roller bed.

28. The system of claim 25 wherein a roller bed is provided to operate in synchronism with said spreading machine, said roller bed including spaced and interconnected rollers arranged transversely of said spreading table and roller drive for rotating said rollers in synchronism with movement of said spreading machine to assist movement of said cloth over said roller bed.

29. The system of claim 28 including a pair of track members supporting said roller bed, said track members being arranged over and under said spreading table, and at least one of said track members including said roller drive.

30. The system of claim 29 wherein said rollers are provided with roller bearings at each end, said roller bearings rotate along said track members during reciprocal motion of said roller bed.

31. The system of claim 28 wherein said roller drive comprises a resilient friction bar carried by said at least one of said track members, said friction bar being arranged to be in pressure contact with said transverse rollers whereby, movement of said roller bed causes rotation of said rollers.

32. The system of claim 28 wherein said rollers are spaced longitudinally at between 6" and 48".

33. The system of claim 25 wherein said directing mechanism includes a cloth edge guide assembly edge alignment rolls which includes transversely arranged and at least one automatically adjustable guide roll which receives said cloth from said support and delivery apparatus and delivers said cloth to said spreading machine so that layers of said cloth are stacked on said spreading table with edges of said layers lying generally in a common plane.

34. The system of claim 33 wherein said directing mechanism includes a frame pivotally mounted with said spreading machine, said frame carrying said guide roll for arcuate movement;

a drive connected with said frame adapted to arcuately move said frame in response to an edge sensor which senses the position of said cloth edge.

35. The system of claim 34 wherein said edge sensor is carried by said spreading machine, said edge sensor sensing one edge of said cloth during delivery thereof and acting to control said frame drive to maintain the position of said cloth edge in a constant line during delivery from said guide roll to said spreading table to stack said cloth layer edges in said common plane.

36. The system of claim 25 including a cloth sensor for sensing depletion of said cloth supply which acts to stop movement of said cloth spreading machine upon depletion of said cloth.

37. The system of claim 25 wherein said stationary cloth supply comprises a supply truck in which cloth is flat folded and a directional roll over which said cloth is guided away from said supply truck.

38. The system of claim 25 wherein said stationary cloth supply comprises a cloth supply roll, at least one driven feed roll receiving cloth from said supply roll, and a supply bin which receives cloth from said roll and from which said cloth is drawn.

39. The system of claim 38 including cloth sensors arranged near said supply bin for activating a cloth roll drive associated with said cloth supply roll and a feed roll drive associated with said feed roll to deliver cloth to said supply bin and maintain cloth in said supply bin within limits.

40. The system of claim 39 wherein said cloth sensors includes a first sensor operative to activate said feed roll and cloth roll drives to deliver said cloth to said supply bin to maintain cloth quantity within said supply bin within limits, and a second sensor operative to deactivate said cloth spreading machine when said cloth in said accumulator drops below said limits.

41. The cloth spreading system of claim 39 including a reference speed sensor for sensing the rate of travel of cloth between said supply roll and feed roll for generating a reference speed signal, and a controller responsive to said cloth sensor and said reference speed sensor for correlating and controlling the drives of said supply roll and said feed roll.

42. A cloth feeding system for delivering cloth to associated textile equipment from a stationary cloth supply, wherein said system comprises:

an overhead cloth support and delivery assembly disposed near said associated textile equipment for delivering and guiding said cloth from said stationary supply to said equipment;

a roller bed included in said cloth support and delivery assembly which moves away from and toward said stationary cloth supply in reciprocating forward and return cycles, said roller bed having a plurality of transverse rollers spaced longitudinally along a length of said roller bed, said cloth being supported on said rollers of said roller bed;

a stationary track included in said cloth support and delivery assembly for supporting said roller bed for reciprocating movement and a roller drive carried by said cloth support and delivery assembly for rotating said rollers in synchronism with movement of said roller bed to assist in advancement of said cloth over said roller bed; and a directing device for directing said cloth from said roller bed to said associated textile equipment.

43. The system of claim 42 a roller bed including a roller bed drive which drives said roller bed over said track in said reciprocating movement so that cloth is drawn over said roller bed and delivered to said equipment.

44. The system of claim 43 wherein said textile equipment is driven in a prescribed movement and said roller bed drive includes an upstanding frame carried by said equipment and a drive connector connecting said frame to said roller bed.

45. The system of claim 42 wherein said roller bed includes spaced and interconnected rollers arranged transversely of said stationary track.

46. The system of claim 45 wherein said roller drive comprises at least a first resilient friction bar arranged to be in pressure contact with said transverse rollers whereby, movement of said roller bed causes rotation of said rollers.

47. The spreading system of claim 46 wherein pneumatic actuators mount and urge said friction bar into position to engage said rollers so that said rollers are driven in the direction of movement of said roller bed.

48. The spreading system of claim 46 wherein said first friction bar is mounted above said roller bed and said roller drive includes a second friction bar, said second friction bar being mounted below said roller, first and second pneumatic actuators respectively connected with said first and second friction bars and adapted to position each said friction bar in a first roller engaging position and a second roller non-engaging position, a control adapted to actuate said first pneumatic actuator to move said first friction bar to said first position while causing said second friction bar to be maintained in said second position during movement of said spreading machine in one direction and to actuate said first pneumatic actuator to move said first friction bar to said second position while causing said second pneumatic actuator to move said second friction bar to said first position during movement of said spreading machine in an opposite direction; whereby, said rollers are caused to rotate in a single direction during reciprocal movement of said cloth spreader.

49. A method of spreading cloth on a spreading table comprising, providing a stationary cloth supply, providing a self propelled cloth spreader, supporting and reciprocating said cloth spreader on said spreading table and delivering said cloth from said stationary cloth supply to said cloth spreader and from said cloth spreader onto said spreading table during each reciprocation thereof;

providing a reciprocating support and delivery assembly and reciprocally driving said support and delivery assembly in synchronism with said cloth spreader over said spreading table;

delivering said cloth from said cloth spreader onto said spreading table in successive flat lengths during each reciprocation of said cloth spreader;

stacking vertically said successive lengths of said cloth with at least one edge thereof being vertically aligned; and withdrawing cloth from said stationary supply during only alternate reciprocations of said cloth spreader.

50. The method of claim 49 including storing a portion of said cloth withdrawn on alternate reciprocations of said cloth spreader on said support and delivery assembly for delivery to said cloth spreader on intermediate reciprocatings thereof.

51. The method of claim 49 including storing said cloth in said cloth supply in the form of a cloth roll.

52. Method of claim 51 including withdrawing said cloth from said cloth roll into an intermediate supply area and subsequently feeding said cloth from said intermediate supply area to said cloth spreader.

53. The method of claim 49 including arranging said cloth in said cloth supply in the form of continuous folded lengths.

54. The method of claim 49 including causing the reciprocal motion of said cloth spreader to withdraw said cloth from said cloth supply.

55. The method of claim 49 including controlling alignment of stacked edges of said cloth during the reciprocal motion of said cloth spreader.

56. The method of claim 49 including moving said cloth over a plurality of driven rolls between said cloth supply and said cloth spreader and controlling the rotational direction of said driven rolls to assist movement of said cloth during movement of said cloth spreader in one direction and to further tension said cloth during movement of said cloth spreader in an opposite direction.

57. The method of claim 49 including moving said cloth over a plurality of driven rolls between said cloth supply and said spreaders and controlling said driven rollers to assist in the movement of said cloth during movement of said cloth spreader in each direction.

* * * * *